US009815590B2

(12) United States Patent
Keane

(10) Patent No.: US 9,815,590 B2
(45) Date of Patent: Nov. 14, 2017

(54) VENTED BEVERAGE CAN END HAVING AN ANTI-TENSION SCORE

(71) Applicant: Crown Packaging Technology, Inc., Alsip, IL (US)

(72) Inventor: Brendan Keane, Deerfield, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/773,882

(22) PCT Filed: Mar. 10, 2014

(86) PCT No.: PCT/US2014/022502

§ 371 (c)(1),
(2) Date: Sep. 9, 2015

(87) PCT Pub. No.: WO2014/150180

PCT Pub. Date: Sep. 25, 2014

(65) Prior Publication Data

US 2016/0023801 A1 Jan. 28, 2016

Related U.S. Application Data

(60) Provisional application No. 61/781,416, filed on Mar. 14, 2013.

(51) Int. Cl.
*B65D 17/34* (2006.01)
*B65D 17/00* (2006.01)

(52) U.S. Cl.
CPC ..... *B65D 17/165* (2013.01); *B65D 17/24* (2013.01); *B65D 2517/008* (2013.01);
(Continued)

(58) Field of Classification Search
CPC B65D 17/165; B65D 17/24; B65D 2517/008; B65D 2517/0095;
(Continued)

(56) References Cited

U.S. PATENT DOCUMENTS 3,977,561 A 8/1976 Strobe et al.
4,289,251 A * 9/1981 Maliszewski ..... B65D 17/165 220/269

(Continued)

FOREIGN PATENT DOCUMENTS

CA 2777915 A1 5/2011
WO WO 2011/053776 A1 5/2011
WO WO 2014/150180 A1 9/2014

*Primary Examiner* — James N Smalley
(74) *Attorney, Agent, or Firm* — Baker & Hostetler LLP

(57) ABSTRACT

A beverage can end for seaming onto a can body may include a peripheral wall, a center panel (26), a tab (attached to the center panel by a rivet (28), a tear panel (60), a main reference line (Rm), a transverse reference line (R1), and a score (30). The end includes an anti-fracture score (40) proximate a vent score (70). The center panel includes a recess (27), in which the main score, an antifracture score, and (optionally) the anti-tension score (50) are located. The score is configured such that lifting the tab from its horizontal rest position to an intermediate position ruptures the main score portion to pivot the tear panel main portion about the hinge (70) and a second lifting operation or twisting operation of the tab ruptures the main score extension (34).

38 Claims, 2 Drawing Sheets

(52) U.S. Cl.
CPC ..... *B65D 2517/0014* (2013.01); *B65D 2517/0062* (2013.01); *B65D 2517/0076* (2013.01); *B65D 2517/0082* (2013.01); *B65D 2517/0095* (2013.01)

(58) Field of Classification Search
CPC .... B65D 2517/0014; B65D 2517/0062; B65D 2517/0076; B65D 2517/0082
USPC ..... 220/269, 271
See application file for complete search history.

(56) References Cited

U.S. PATENT DOCUMENTS

| | | | | |
|---|---|---|---|---|
| 5,011,037 | A | 4/1991 | Moen et al. | |
| 5,555,992 | A | 9/1996 | Sedgeley | |
| 6,079,583 | A | 6/2000 | Chasteen | |
| 6,354,453 | B1 | 3/2002 | Chasteen | |
| 7,594,585 | B1 | 9/2009 | Fields | |
| 2003/0075544 | A1* | 4/2003 | Turner | B21D 51/38 220/269 |
| 2004/0099664 | A1* | 5/2004 | Hartman | B65D 17/165 220/269 |
| 2012/0031056 | A1 | 2/2012 | Chasteen et al. | |
| 2012/0082529 | A1 | 4/2012 | Blei et al. | |
| 2013/0037542 | A1 | 2/2013 | Crothers | |
| 2013/0126529 | A1* | 5/2013 | Nesling | B65D 17/165 220/271 |

* cited by examiner

VENTED BEVERAGE CAN END HAVING AN ANTI-TENSION SCORE

CROSS-REFERENCE TO RELATED APPLICATIONS

This application is the National Stage of International Application No. PCT/US2014/022502, filed Mar. 10, 2014, which claims the benefit of U.S. Provisional Application No. 61/781,416 filed Mar. 14, 2013, the disclosures of which are incorporated herein by reference in their entireties for any and all purposes.

TECHNICAL FIELD

The present invention relates to metal packaging, and more particularly to optionally vented openings in metal beverage can ends.

BACKGROUND

Aluminum beverage cans are produced in vast quantities. Conventional beverage cans include a one-piece, drawn and ironed body and an end that is attached to a flange of the can body by a double seam. A can end, in its unseamed state, has a peripheral curl for seaming to the can body flange, a wall extending from the curl (that is, a chuck wall), an annular bead (that is, a countersink), or like structure extending from the wall and a center panel.

Conventional center panels have a score that defines a tear panel and a tab that is attached to the center panel by a rivet. The score has first and second ends that define a hinge about which the tear panel actuates. In the vast majority of commercial ends, the hinge is not centered relative to the score and tear panel, but rather is located to a side. The score extends from its first end in front of the rivet about a curved path to its second end. Conventional large opening ends (LOE) have an elongated opening.

Commercial ends of the LOE-type are opened only by lifting the heel of the tab to force the tab nose against the tear panel. The downward force initiates an initial venting, which is promoted by a check slot, and the downward force then displaces the tear panel and ruptures the remainder of the score to form an opening.

Pouring from conventional beverage cans creates unsteady state flow or "glugs," as described in U.S. patent application Ser. No. 09/857,145, which is assigned to the assignee of the present invention.

U.S. Pat. Nos. 6,354,453; 6,079,583; 5,555,992; 5,011,037; and 3,977,561 disclose can ends that have been purported to create a vent after opening. There is a need for improved can end configurations that promote venting after opening of the tear panel.

Making a score in a metal sheet causes a phenomenon referred to as metal flow or slack metal. Slack metal is created when a tool impacts the sheet metal of a commercial beverage can end to create a score. The second score common to many commercial beverage can ends is known as an antifracture score, the purpose of which is to resist metal flow. A recess can reduce or take up slack metal. Other means for effecting slack metal are known.

A popular type of recess for 12 ounce beverage cans is known as a Stolle-type recess or a Stolle-type end, which has a pair of opposing rounded ends between tapering sides to give the appearance of a trapezoid having rounded opposing sides. In a Stolle-type end, the tab and tear panel are located within the recess.

Another popular center panel configuration, known as a DRT style end, does not have a recess that encompasses the tear panel and tab, but rather includes raised beads. Further, a typical DRT style center panel includes only a single score (that is, does not have an antifracture score). The single score of the DRT-style end typically has a different score profile (in transverse cross section) than a typical score profile of a Stolle-style main score. U.S. Patent publication US20130037542, which is incorporated herein, shows an embodiment of a DRT-style center panel.

SUMMARY

Publication WO 2011/053776 (the 776 Publication), which is owned by the assignee of the present invention, discloses embodiments of a vented beverage can end that include a score extension that extends rearward from an end of the main score. Rupturing the score extension, such as by a second actuation of the tab, provides a vent that enhances pouring. The disclosure of the 776 Publication is incorporated herein.

The inventor has discovered a particular problem in some embodiments of the end disclosed in the 776 Publication. The conventional Stolle-type recess created excess tension across the vent score extension. Moreover, the inventor believes that a vent score extension like that disclosed in the 776 application would under many circumstances be under tension in a DRT style end, with or without a recess panel. Although too much slack metal is often a problem in end panels, because it can create unreliability in the process of score rupture, the inventor has determined that an anti-tension score or a third score—that is, in addition to the main score and antifracture score—creates sufficient slack metal to mitigate the high tension in the region of the score extension and vent opening.

According to a first combination of features, a beverage can end for seaming onto a can body is provided. The can end comprises: a peripheral wall; a center panel; a tab attached to the center panel by a rivet; a tear panel including (i) a main portion capable of pivoting about a hinge and (ii) a vent portion. The can end features may be defined relative to a main reference line that bisects the tear panel main portion and extends through the rivet and a transverse reference line that is perpendicular to the main reference line and extends through the rivet. The hinge is offset relative to the main reference line and a main portion of the tear panel is located in front of the transverse reference line.

A primary score includes an arcuate main score that defines the main portion of the tear panel and a main score extension defines the vent portion. A first end of the main score (i) defines one end of the hinge and (ii) is located on the hinge-side of the main reference line and in front of the transverse reference line. A second end of the main score (i) defines one end of the main score extension and (ii) is located on the hinge-side of the main reference line and to the rear of the transverse reference line. An anti-tension score follows the main score extension. The primary score is configured such that actuating the tab, such as by lifting, from its horizontal rest position to an intermediate position ruptures the main score portion to pivot the tear panel main portion about the hinge and returning the tab to a near-rest position, rotating the tab approximately 90 degrees in the direction of the main score extension and lifting the tab again from a near-rest position to an intermediate position ruptures the main score extension. Alternatively, the vent score may be opened by rotating the tab in the direction of the main score extension when the tab is upright or nearly upright, or the tab may be rotated after it has been returned to its intermediate position.

Preferably, the main portion of the tear panel is elongated in the transverse direction and has an aspect ratio between 1.3 and 1.7. The hinge is defined between the main score first end and an intermediate point of the main score that is at the base of the main score extension. The main score extension is positioned such that it extends rearward from the intermediate point across the transverse reference line into the first rear quadrant. The length of the main score extension and anti-tension score preferably is no longer than three times the hinge length, more preferably no longer than two times the hinge length.

Optionally, the can end may contain an antifracture score that follows the arcuate main score, and may be uniformly spaced from the main score. The can end may be configured such that the main score, the antifracture score, the anti-tension score, and the rivet are located in a recess in the center panel.

The antifracture score may also include an antifracture score extension that follows the main score extension. If present, the antifracture score preferably is located on an inboard side of the main score. The anti-tension score is located on an outboard side of the main score.

The can end may also be configured such that the main score extension, the antifracture score extension, and the anti-tension score define arcs that generally correspond to the path of the tab when rotated in the further actuation from the intermediate position. Opening the vent score is optional.

The main score profile may be defined relative to the main reference line and the transverse reference line that divide the center panel into first and second front quadrants and first and second rear quadrants. In this regard, the main score extends from the main score first end in the first front quadrant across to the main reference line near the rivet to extend into the second front quadrant. It then traces an arcuate path through the second front quadrant, across the main reference line near the front-most portion of the center panel, continuing in an arcuate path in the first front quadrant to an intermediate point located in the first front quadrant, thus defining the second end of the hinge opposite the main score first end.

According to a second combination of features, a beverage can end for seaming onto a can body is provided. The can end comprises: a peripheral wall; a center panel; a tab attached to the center panel by a rivet; a tear panel including (i) a main portion capable of pivoting about a hinge and (ii) a vent portion. The primary score comprising an arcuate main score that defines the main portion of the tear panel and a main score extension that defines the vent portion. An antifracture score comprises an antifracture main portion and an antifracture score extension that are approximately coextensive with the main score and the main score extension, respectively. An anti-tension score follows the main score extension and provides slack, which eases tensile stress across the main score extension. A recess is formed in the center panel. The recess contains the main score, the anti-fracture score, and the rivet.

The primary score is configured such that lifting the tab from its horizontal rest position to an intermediate position ruptures the main score portion to pivot the tear panel main portion about the hinge and returning the tab to a near-rest position, rotating the tab approximately 90 degrees in the direction of the main score extension and lifting the tab again from a near-rest position to an intermediate position ruptures the main score extension. Alternatively, the vent score may be opened by rotating the tab in the direction of the main score extension when the tab is upright or nearly upright or the tab may be rotated after it has been returned to its intermediate position. Opening the vent score is optional.

The anti-tension score may be located such that it is completely in the recess, entirely outside of the recess, or at least a portion of the anti-tension score is outside the recess, such as when the anti-tension score crosses the transition or transition wall of the recess. Further, the anti-tension score preferably is substantially coextensive with the main score extension for substantially the entire extent of the main score extension. The antifracture score is substantially coextensive with the main score for substantially the entire extent of the main score. Additionally, the antifracture score is equidistant from the main score for substantially the entire extent of the main score. The antifracture score is located on an inboard side of the main score and the anti-tension score is located on an outboard side of the main score. Further, the main score extension, antifracture score extension, and anti-tension score define an arc that generally corresponds to the path of the tab when rotated in the direction of the main score extension while in an upright or nearly upright position.

The can end features may be defined relative to a main reference line that bisects the tear panel main portion and extends through the rivet and a transverse reference line that is perpendicular to the main reference line and extends through the rivet. The hinge is offset relative to the main reference line and a main portion of the tear panel is located in front of the transverse reference line. The primary or main score includes an arcuate main score portion that defines the main portion of the tear panel and a main score extension defines the vent portion. A first end of the main score (i) defines one end of the hinge and (ii) is located on the hinge-side of the main reference line and in front of the transverse reference line. A second end of the main score (i) defines one end of the main score extension and (ii) is located on the hinge-side of the main reference line and to the rear of the transverse reference line.

The can end features may be further defined relative to the main reference line and the transverse reference line that divide the center panel into first and second front quadrants and first and second rear quadrants. The main score extends from the main score first end in the first front quadrant across to the main reference line near the rivet to extend into the second front quadrant. It then traces an arcuate path through the second front quadrant, across the main reference line near the front-most portion of the center panel, continuing in an arcuate path in the first front quadrant to an intermediate point located in the first front quadrant, thus defining the second end of the hinge opposite the main score first end.

Preferably, the main portion of the tear panel is elongated in the transverse direction and has an aspect ratio between 1.3 and 1.7. The hinge is defined between the main score first end and the intermediate point at the base of the main score extension. The main score extension is positioned such that it extends from the intermediate point rearward across the transverse reference line into the first rear quadrant. The length of the main score extension and anti-tension score is no longer than three times the hinge length. Alternatively, the main score extension and anti-tension score length is no longer than two times the hinge length.

DETAILED DESCRIPTION OF ILLUSTRATIVE EMBODIMENTS

Figure 2:
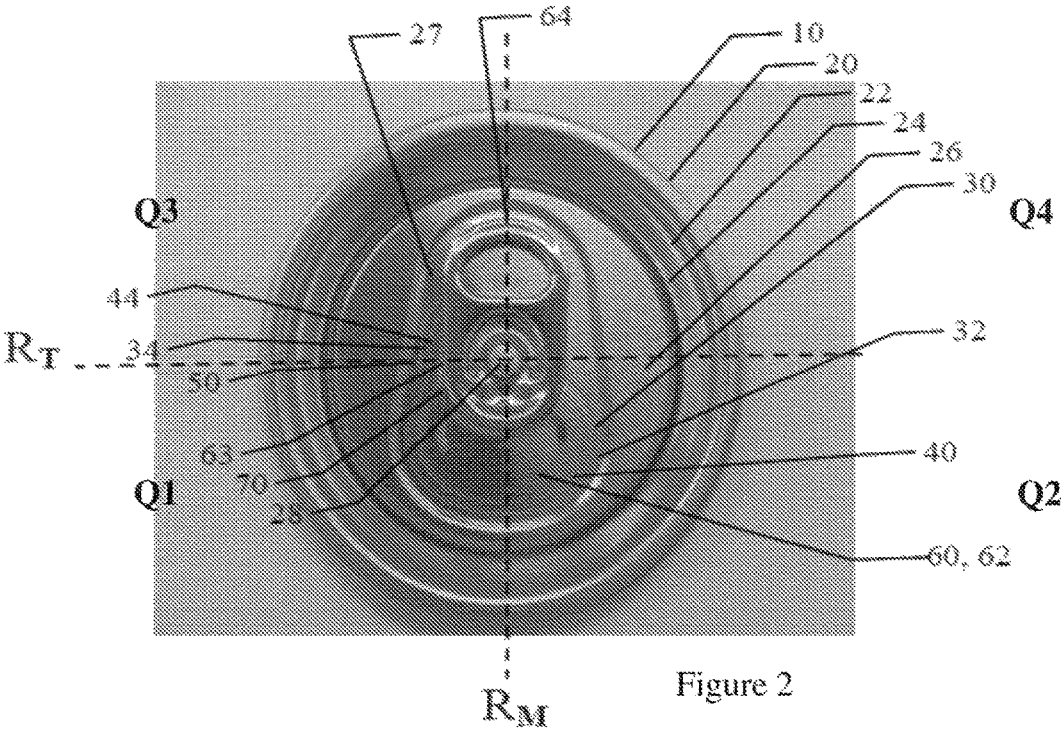
FIG. 2 is a top-view image of a beverage can end having the score configuration of FIG. 1.
Figure 5:
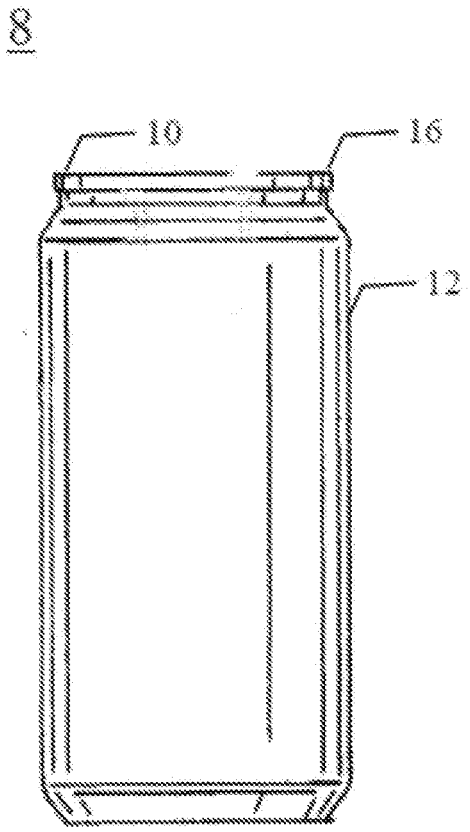
FIG. 5 is a side view of a beverage can having the end of FIG. 1.

A beverage can 8 (FIG. 5) illustrating an embodiment of the present invention includes a first embodiment can end 10 attached to a can body. The can body 12 preferably is formed of aluminum by a drawing and ironing process. The can end 10, which is shown unseamed in FIG. 2, is attached to can body 12 by a conventional double seam 16.

Can end 10 includes a peripheral curl 20, a wall 22, an annular reinforcing bead 24, a center panel 26, and a tab 64. Curl 20 is of the type that can be deformed by a conventional seaming technique to form a seam with a flange of a can body. Wall 22 extends inwardly from curl 20. Bead 24 opens upwardly and connects wall 22 to center panel 26. The present invention is not limited to the style of end shell, and encompasses current commercial ends shells of all types.

A rivet 28 is formed in center panel 26. Preferably, rivet 28 is conventional. Tab 64 includes a rivet island through which a rivet 28 extends to couple tab 64 to the center panel. Center panel 26 includes a recess portion 27, such as a recess typically referred to as a Stolle-type recess. Center panel 26 and recess 27 are flat, as that term is understood given normal manufacturing tolerances and including the deformation of the end typical for carbonated beverages.

Recess 27 has a relative wide portion at its front that is large enough such that tear panel main portion 62 is located entirely within recess 27. Recess 27 tapers rearwardly. In this regard, recess 27 has a tapered, wide end on the front side of the end, a pair of opposing, straight sidewalls that extend rearwardly from its front end, an a curved, relatively narrow rear end. As explained below, recess 27 is sized to enable the scores to be formed therein, and for tab 64 to reside within the boundary of recess 27, although tab 64 is vertically spaced above recess 27 and center panel 26.

Recess panel 27 includes a main score 30, an antifracture score 40, and an anti-tension score or third score 50. Main score 30 includes main tear panel score portion 32 and a score extension or vent score 34. Main tear panel score portion 32 and score extension 34 define a displaceable tear panel 60 having a main portion 62 and a vent portion 63.

To aid in the description of end 10, a main reference line $R_M$ is defined as bisecting the main portion 62 of the tear panel 60 and extending through the center of the rivet 28. A transverse reference line $R_T$ is defined as perpendicular to the main reference line $R_M$ on the center panel 26 and extending through the center of the rivet 28. For tear panels having a main portion that is asymmetrical (not shown), line $R_M$ may be drawn through the rivet to divide the area of the main portion of the tear panel into equal areas. The transverse reference line $R_T$ defines the front and rear directions or locations. The side of the transverse reference line $R_T$ on which main portion 62 of tear panel 60 is located is referred to as the front of can end 10, and the opposing side is referred to as the rear. The reference lines $R_M$ and $R_T$ form first and second front quadrants Q1 and Q2 and first and second rear quadrants Q3 and Q4. When the front of the can end 10 is depicted below the rear of the can end 10 as shown in FIG. 2, Quadrants Q1 and Q3 are located on the left side (also referred to as the hinge side) of the main reference line $R_M$ and quadrants Q2 and Q4 are located on the opposing right side of the main reference line $R_M$.

Figure 1:
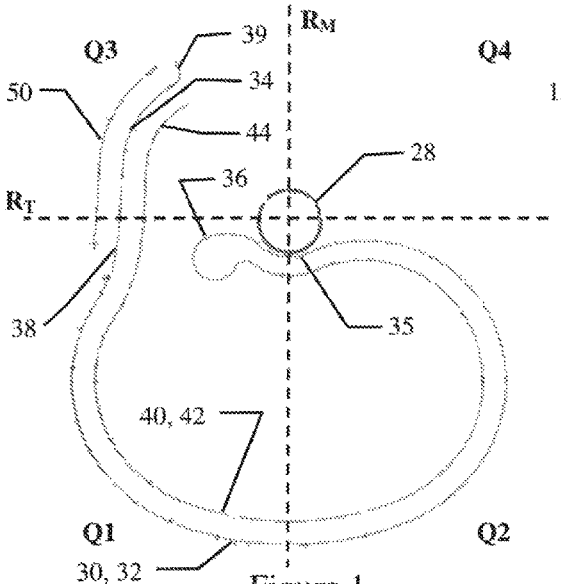
FIG. 1 is an enlarged view of a score configuration of an end.

Main score 30 extends from a first end 36 (shown in FIG. 1 and hidden from view in FIG. 2 by tab 64), which is located to the front of the rivet 28 in the front quadrant Q1. Main score 30 extends across main reference line $R_M$ near and in front of the rivet 28 into front right quadrant Q2 in an arcuate path. A check slot 35 (shown in FIG. 1 and hidden from view in FIG. 2 by rivet 28), which is intended to temporarily stop or inhibit the opening of the main score 30 near the rivet 28 to allow for initial venting of the beverage can end 10, may be located in the main score 30 near the rivet 28. Accordingly, a portion of score 30 near first end 36 functions as a conventional, momentary vent upon initial opening.

Past the check slot 35, the main score 30 extends in an arcuate path through Q2, the extent of which defines a side of the main portion 62 of the tear panel 60, and again crosses the main reference line $R_M$ and into the front left quadrant Q1 near the chuck wall 22 and near the front-most portion of the center panel 26. Main score 30 continues farther from the front of center panel 26 through the front left quadrant Q1 in an arcuate path until the main score 30 approaches and extends to an intermediate point 38. Preferably, intermediate point 38 is located in the front left quadrant Q1 on the front side of the transverse reference line $R_T$ and on the same side of the main reference line $R_M$ as the score first end 36. Main score 30 extends toward main reference line $R_M$ after forming the left-most portion of main panel portion 62, and score extension 34 extends from intermediate point 38 on a curved path that has a leftward component (as viewed in FIG. 2). Other configuration of main tear panel score portion 32 and vent score 34 and encompassed by the present invention, including a sharp curve such that the intermediate point is formed on a peninsula-like protrusion that forms a point and roughly triangular shape, a discontinuous score such that a small gap exists between scores 32 and 34, and other score arresting features.

Score first end 36 and the intermediate point 38 define a hinge 70, which hinge 70 defines the boundary of main portion 62 of tear panel 60 and defines the structure about which the main portion 62 of the tear panel 60 pivots when the tear panel 60 is opened. In the embodiment shown, hinge 70 is located on the front side of the transverse reference line $R_T$ and on the hinge side (also the left side in the figures) of the main reference line $R_M$ in quadrant Q1.

Score extension 34 extends rearward from intermediate point 38 past the transverse reference line $R_T$ and into the rear left quadrant Q3, without crossing the main reference line $R_M$, to terminate at a second end 39 of the score 30. As shown, the score extension 34 has a hook-shape or curvature, and the present invention encompasses other score extension configuration, such as those disclosed in the 776 Publication.

Antifracture score 40 is located on the inboard side of main score 30 and follows main score 30 (that is, has the generally same shape and located near to) is approximately coextensive with main score 30. Antifracture score 40 includes an antifracture main score 42 and an antifracture score extension 44. The present invention also encompasses an embodiment in which antifracture score does not exist, but rather antifracture score 50 terminates near intermediate point 38. Antifracture main score 42, as shown in the figures, is offset from the main tear panel score portion 32 and is uniformly spaced apart (that is, equidistantly spaced apart) from main tear panel score portion 32 for the entire extent of main tear panel score portion 32. Antifracture score extension 44 is offset from the main score extension 34 and is uniformly spaced apart or equidistantly spaced apart from main score extension 34 for the entire extent of main score extension 34. Antifracture 40 performs the well-known function of controlling metal flow relative to main score 30.

Anti-tension score 50 is preferably a relatively short score that follows main score extension 34 and is located on the outboard side of score extension 34 on the opposite side from antifracture score extension 44. Anti-tension score 50 is offset from the main score extension 34 and is uniformly spaced apart or equidistantly spaced apart from main score extension 34 for the entire extent of main score extension 34.

FIG. 2 shows that the anti-tension score 50 is located entirely within recess 27. The present invention also encompasses an anti-tension score (not shown in the figures) that is entirely located outside of recess 27 and an anti-tension score (not shown in the figures) that is at least partially located in the transition wall between recess 27 and the upper portion of central panel 26. The inventor surmises that a benefit of the anti-tension score (that is, diminishing tension in the region of the vent score) can be achieved by locating an anti-tension score in any of the places and configurations described.

A second embodiment of an end having an anti-tension score employs an end shell that does not require a Stolle-style recess. Rather, in the second embodiment a recess is optional (that is, the present invention encompasses ends having a recess and ends that do not have a recess), and for convenience of illustration a recess be omitted from the description of can end 110. The second embodiment end, which is referred to by reference numeral 110, includes the shell curl, wall, and countersink bead structure as described above for first embodiment end 10. End 110 may include beads (not shown) of the type that encompass the outboard side of the score and that are formed on the tear panel.

Figure 3:
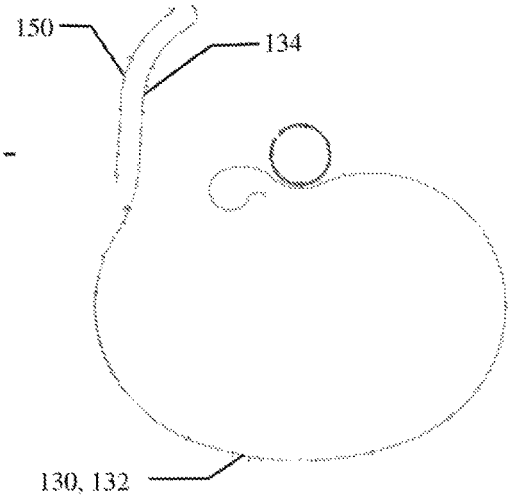
FIG. 3 is an enlarged view of another score configuration.

The score configuration of end 110 is shown in schematically FIG. 3. End 110 includes a main score 130 that includes a main tear panel score portion 132 and a vent score or score extension 134, each of which may be as described above for main score 30, main tear panel score portion 32, and vent score 34. End 110 also includes an anti-tension score 150 that is conceptually the same as anti-tension score 50. Thus, the description of anti-tension score 50 of the first embodiment applies to anti-tension score 150 of the second embodiment. FIG. 3 illustrates main score 130 and anti-tension score 150, and illustrates that anti-tension score 150 follows vent score 134, which are uniformly spaced apart. End 110 does not have an anti-fracture score on the inboard side of main score 130.

The inventor has found that an anti-tension score extension can diminish vented end problems caused by excess tension across the vent score created by a recess, inherent in the panel, created by beads, and the like. In this regard, excess slack metal is normally detrimental to end functioning, but the slack metal created by the configurations described herein counteracts the unexpectedly high tension created by the recess or otherwise present in the end. The configuration of the scores, including the anti-tension score, such as width and score residual dimension, can be chosen according the desired parameters of the end upon consideration of this disclosure, as will be understood by persons familiar with beverage end technology. All scores described herein may be formed by conventional methods.

Figure 4:
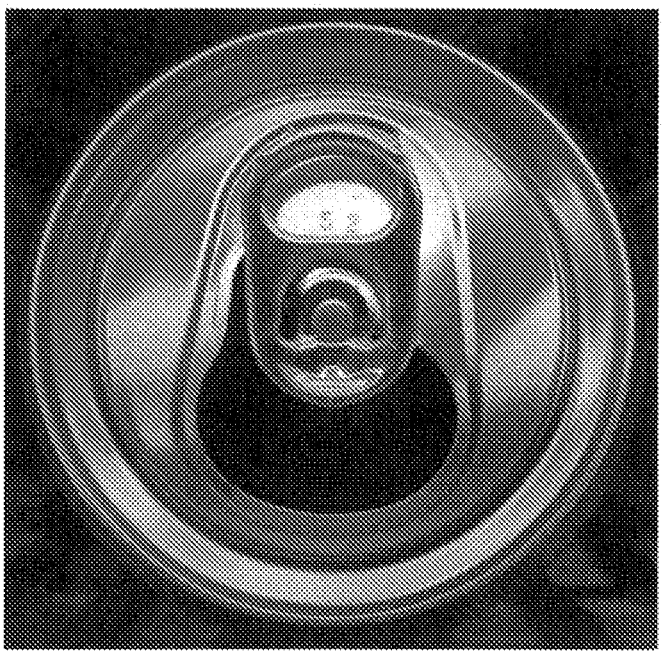
FIG. 4 is a top view image of a beverage can having the end of FIG. 2 seamed onto a can body.

A method of operation of can end 10 includes opening the main tear panel 62 by lifting the heel of tab 64 to rupture main tear panel score portion 32, as is conventional. Tab 64 may then be returned to near its normal at-rest position, rotated approximately 90 degrees in the direction of the main score extension 34, and then the heel of tab 64 is lifted once again to rupture main score extension 34 to produce a vent, as more fully described in the 776 Publication. FIG. 4 illustrates end 10 in the open position with the vent fully activated and tab 64 returned to its original, at-rest position.

An alternative method of operation of can end 10 includes opening the main tear panel 62 by lifting the heel of tab 64 to rupture main tear panel score portion 32, as is conventional, then rotating the tab, while it is in an intermediate position, to rupture main score extension 34 to produce a vent.

The foregoing description is provided for the purpose of explanation and is not to be construed as limiting the invention. While the invention has been described with reference to preferred embodiments or preferred methods, and with reference to particular combinations of features in the summary section, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the claims. Further, several advantages have been described that flow from the structure and methods; the present invention is not limited to structure and methods that encompass any or all of these advantages. For example, the anti-tension score has been explained in regards to diminishing tension in the region of the vent score, but the present invention is not limited to this theory or function. Further, the term anti-tension score is intended to refer to structure of the score and is not limited to scores having the result of diminishing tension so long as another benefit is conferred. Those skilled in can end technology, having the benefit of the teachings of this specification, may effect numerous modifications to the invention as described herein, and changes can be made without departing from the scope and spirit of the invention as defined by the appended claims.

What is claimed:

1. A beverage can end for seaming onto a can body, the can end comprising: a peripheral wall; a center panel; a tab attached to the center panel by a rivet; characterized by:

- a tear panel including (i) a main portion capable of pivoting about a hinge and (ii) a vent portion;
- a main reference line that bisects the tear panel main portion and extends through the rivet, the hinge being offset relative to the main reference line;
- a transverse reference line that is perpendicular to the main reference line and extends through the rivet, the main portion of the tear panel being located in front of the transverse reference line;
- a primary score including an arcuate main score that defines the main portion of the tear panel and a main score extension that defines the vent portion,
  - a first end of the main score (i) defines one end of the hinge and (ii) is located on the hinge-side of the main reference line and in front of the transverse reference line (Q1),
  - an intermediate point between the main score and the main score extension, the intermediate point is located on the hinge-side of the main reference line and either in front of the transverse reference line (Q1) or behind the transverse reference line (Q3), the main score extension extending from the intermediate point to an end of the main score extension that is located on the hinge-side of the main reference line and to the rear of the transverse reference line (Q3); and an anti-tension score that follows the main score extension;

whereby the score is configured such that lifting the tab from its horizontal rest position to an intermediate position ruptures the main score portion to pivot the tear panel main portion about the hinge and either a second lifting operation or a twisting operation ruptures the main score extension.

2. The can end of claim 1 wherein the intermediate point forms a second end of the main hinge.

3. The can end of claim 1 further comprising an antifracture score that includes an antifracture main score that follows the arcuate main score.

4. The can end of claim 2 wherein each one of the main score, the antifracture score, the anti-tension score, and the rivet are located in a recess in the center panel.

5. The can end of claim 4, wherein the antifracture score includes an antifracture score extension that follows the main score extension.

6. The can end of claim 4 wherein the anti-tension score is located on an outboard side of the main score.

7. The can end of claim 5 wherein the antifracture score is located on an inboard side of the main score.

8. The can end of claim 7 wherein the anti-tension score is located on an outboard side of the main score.

9. The can end of claim 8, wherein the main score extension, the antifracture score extension, and the anti-tension score define arcs that generally correspond to the path of the tab when rotated in the further actuation from the intermediate position.

10. The can end of claim 4, wherein the antifracture score is approximately uniformly spaced from the main score.

11. The can end of claim 4, wherein the primary score is configured such that the actuation of the tab from the intermediate position is optional such that, during use, opening the vent portion is optional.

12. The can end of claim 1, wherein the main portion of the tear panel is elongated in a transverse direction.

13. The can end of claim 11, wherein the main portion of the tear panel has an aspect ratio between 1.3 and 1.7.

14. The can end of claim 1, wherein the main reference line and the transverse reference line divide the center panel into first and second front quadrants and first and second rear quadrants, the main score extending (i) from the main score first end in the first front quadrant (Q1) across the main reference line near the rivet to extend into the second front quadrant (Q2), (ii) in an arcuate path in the second front quadrant (Q2), (iii) across the main reference line near the front-most portion of the center panel, (iv) in an arcuate path in the first front quadrant (Q1), (v) to an intermediate point located in the first front quadrant (Q1) and defining an end of the hinge opposite the main score first end.

15. The can end of claim 14, wherein the main score extension extends from the intermediate point across the transverse reference line into the first rear quadrant.

16. The can end of claim 14, wherein the hinge is defined between the main score first end and an intermediate point on the score at the base of the main score extension.

17. The can end of claim 14, wherein each one of the main score extension and the anti-tension score is no longer than three times the length of the hinge.

18. The can end of claim 14, wherein each one of the main score extension and the anti-tension score is no longer than two times the hinge.

19. A beverage can end for seaming onto a can body, the can end comprising: a peripheral wall; a center panel; a tab attached to the center panel by a rivet; characterized by a tear panel including (i) a main portion capable of pivoting about a hinge and (ii) a vent portion;

a primary score including:

an arcuate main score that defines the main portion of the tear panel and a main score extension that defines the vent portion;

an antifracture score that includes an antifracture main portion and an antifracture score extension that are approximately coextensive with the main portion of the tear panel and the main score extension, respectively; and an anti-tension score that follows the main score extension such that the anti-tension score is uniformly spaced apart from the main score extension;

a recess formed in the center panel, each one of the main score, the antifracture score, and the rivet being located in the recess, whereby the anti-tension score provides slack metal for easing tensile stress across the main score extension.

20. The beverage can end of claim 19, wherein the anti-tension score is located in the recess.

21. The beverage can end of claim 19, wherein at least a portion of the anti-tension score is located outside of the recess.

22. The beverage can end of claim 19, wherein the anti-tension score is located entirely outside of the recess.

23. The beverage can end of claim 19, whereby the score is configured such that actuation of the tab from its horizontal rest position to an intermediate position ruptures the main score portion to pivot the tear panel main portion about the hinge and returning the tab to a near-rest position, rotating the tab approximately 90 degrees in the direction of the main score extension and actuating the tab again from a near-rest position to an intermediate position ruptures the main score extension, or whereby the primary score is configured such that twisting of the tab while in the intermediate position ruptures the main score extension.

24. The beverage can end of claim 19, wherein the antifracture score is substantially coextensive with the main score for substantially the entire extent of the main score.

25. The beverage can end of claim 23, wherein the anti-tension score is substantially coextensive with the main score extension for substantially the entire extent of the main score extension.

26. The beverage can end of claim 25, wherein the antifracture score is equidistant from the main score for substantially the entire extent of the main score.

27. The can end of claim 19, wherein the antifracture score is located on an inboard side of the main score and the anti-tension score is located on an outboard side of the main score.

28. The can end of claim 18, wherein each one of the main score extension, the antifracture score extension, and the anti-tension score defines an arc that generally corresponds to the path of the tab when rotated in the direction of the main score extension while in the intermediate position.

29. The can end of claim 19, wherein the end includes (i) a main reference line that bisects the tear panel main portion and extends through the rivet, the hinge being offset relative to the main reference line; and (ii) a transverse reference line that is perpendicular to the main reference line and extends through the rivet, the main portion of the tear panel being located in front of the transverse reference line; a first end of the main score (i) defines one end of the hinge and (ii) is located on the hinge-side of the main reference line and in front of the transverse reference line, a second end of the score (i) defines one end of the main score extension and (ii) is located on the hinge-side of the main reference line and to the rear of the transverse reference line.

30. The can end of claim 29, wherein the score is configured such that the actuation from the intermediate position is optional.

31. The can end of claim 29, wherein the main portion of the tear panel is elongated in a transverse direction.

32. The can end of claim 31, wherein the main portion of the tear panel has an aspect ratio between 1.3 and 1.7.

33. The can end of claim 29, wherein the main reference line and the transverse reference line divide the center panel into first and second front quadrants and first and second rear quadrants, the score extending (i) from the score first end in the first front quadrant across to the main reference line near the rivet to extend into the second front quadrant, (ii) in an arcuate path in the second front quadrant, (iii) across the main reference line near the front-most portion of the center panel, (iv) in an arcuate path in the first front quadrant, (v) to an intermediate point located in the first front quadrant and defining an end of the hinge opposite the score first end.

34. The can end of claim 19, wherein the main score extension extends from the intermediate point across the transverse reference line into the first rear quadrant.

35. The can end of claim 19, wherein the hinge is defined between the main score first end and an intermediate point on the main score at the base of the main score extension.

36. The can end of claim 19, wherein each one of the main score extension and the anti-tension score is no longer than three times the length of the hinge.

37. The can end of claim 19, wherein each one of the main score extension and the anti-tension score is no longer than two times the hinge.

38. The can end of claim 19, wherein each one of the main score extension, the antifracture score extension, and the anti-tension score defines an arc that generally corresponds to the path of the tab when rotated in the direction of the main score extension while in the intermediate position.

* * * * *